United States Patent [19]

Capra

[11] 4,105,145

[45] Aug. 8, 1978

[54] MECHANICALLY OPERATED DISPENSING DEVICE

[75] Inventor: Nicholas G. Capra, East Hanover, N.J.

[73] Assignees: James D. Pauls; J. Claybrook Lewis, both of Miami, Fla. ; part interest to each

[21] Appl. No.: 724,006

[22] Filed: Sep. 16, 1976

[51] Int. Cl.[2] ..... B05B 11/00

[52] U.S. Cl. ..... 222/340; 222/380; 222/383; 239/331

[58] Field of Search ..... 222/340, 336, 380, 382, 222/383, 384; 239/331, 350

[56] References Cited

U.S. PATENT DOCUMENTS

| | | | |
|---|---|---|---|
| 1,575,423 | 3/1926 | Fenton | 222/380 X |
| 1,676,358 | 7/1928 | Schott | 222/340 |
| 2,796,204 | 6/1957 | Math | 222/340 X |
| 3,792,800 | 2/1974 | Capra et al. | 222/340 X |

*Primary Examiner*—Robert B. Reeves
*Assistant Examiner*—Frederick R. Handren
*Attorney, Agent, or Firm*—Shoemaker and Mattare, Ltd.

[57] ABSTRACT

A dispensing device includes a manually operable loading member carried by and accessible exteriorly of a container having a material to be dispensed, with the loading member connected through a gear arrangement with a material dispensing piston reciprocable in a dispensing chamber which is in communication with the interior of the container. Operation of the loading member in a first direction effects reciprocation of the piston in a first direction to draw material into the dispensing chamber, and a spring acts on the piston to move it in a second direction to dispense the material from the chamber through a nozzle for use as desired.

17 Claims, 12 Drawing Figures

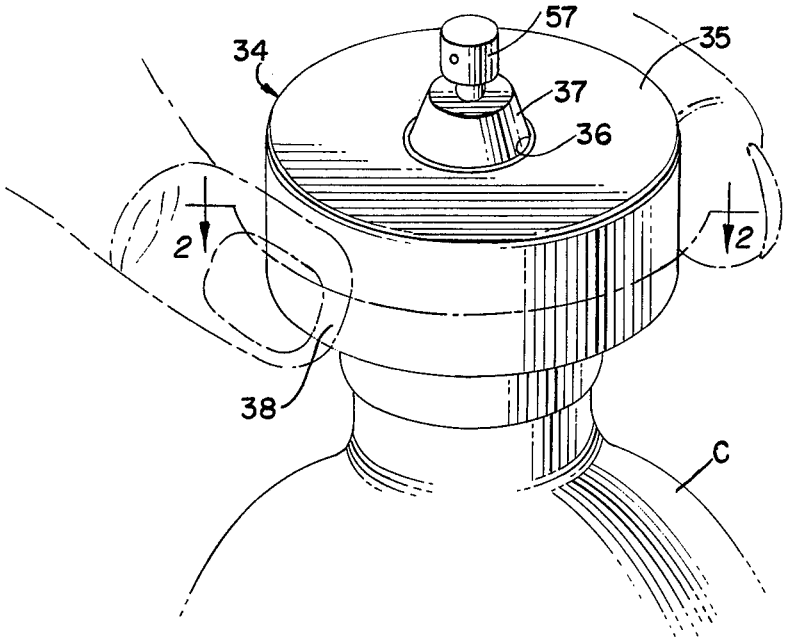
FIG. 1.
FIG. 2.
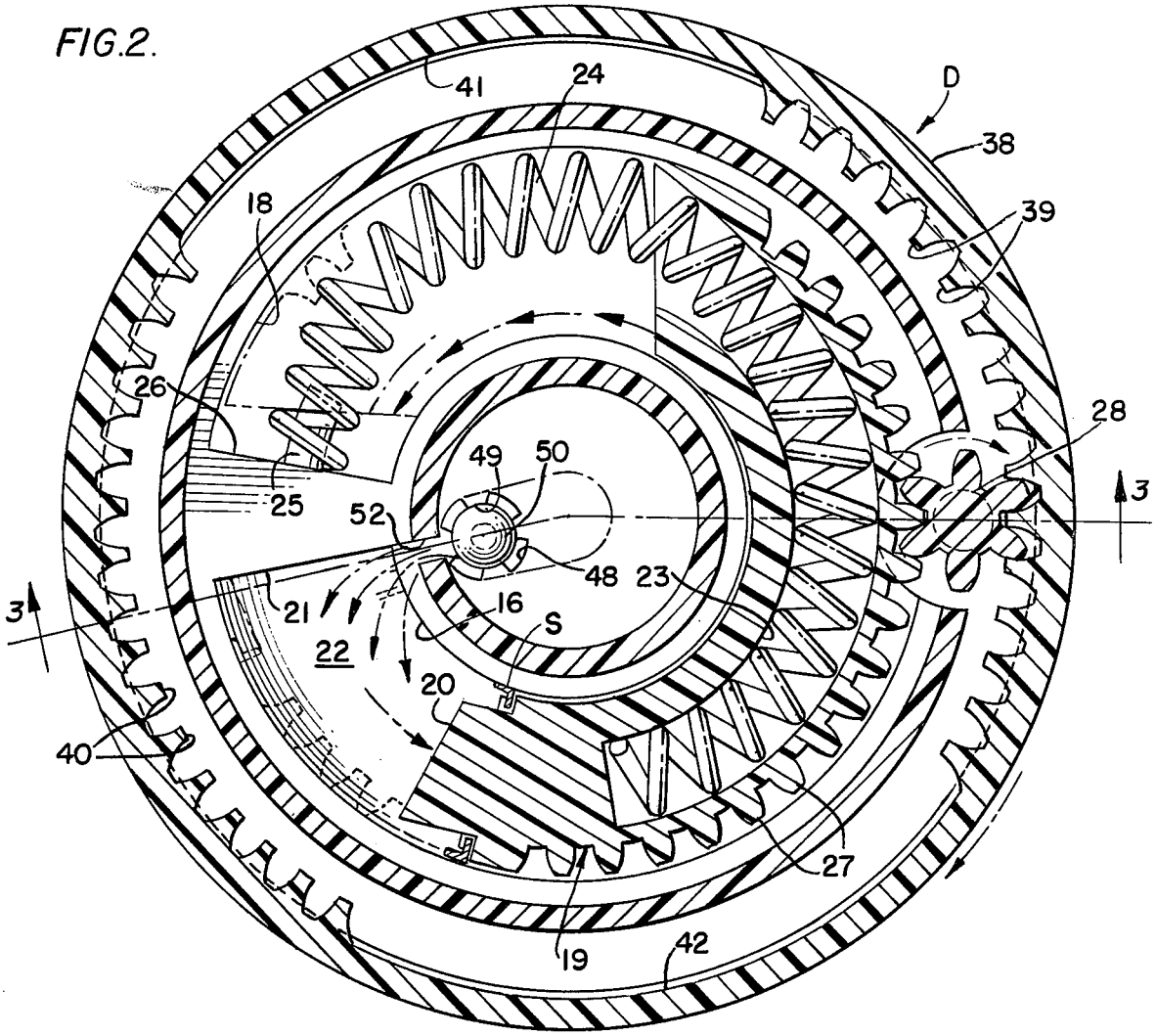

MECHANICALLY OPERATED DISPENSING DEVICE

BACKGROUND OF THE INVENTION

This invention relates to dispensing devices, and more particularly, to dispensing devices for dispensing materials under pressure. Examples of prior devices of the type with which the present invention is concerned are disclosed in applicant's prior U.S. Pat. Nos. 3,792,800 and 3,901,414.

Most dispensing devices presently available utilize aerosol propellants stored under pressure in the container to propel the material therefrom. However, such devices are hazardous to small children who may unwittingly spray the material into their face. Moreover, pressurized aerosol containers are relatively unsafe to use because of the pressures developed therein, and they must be stored in relatively cool places, since the containers may explode when they are subjected to excessive temperatures. Further, in recent years concern has been expressed over the potential damage to the environment caused by the aerosol propellants or products used in such containers. A further disadvantage of such aerosol containers is that only a limited number of products may be used therewith, due to chemical incompatability of the aerosol propellants and the material to be dispensed. Additionally, containers for use with aerosol products must generally be made cylindrical in order to withstand the pressures within the container.

Applicant's prior patents noted hereinabove offer a solution to the problems associated with aerosol containers, but even applicant's previously patented devices have disadvantages. For example, an end of the container must be turned in order to charge the dispensing container with material to be dispensed, thus creating manufacturing problems and increasing the expense of the devices, as well as increasing the likelihood of leaks occurring.

The present invention, on the other hand, offers a unique solution to the problems associated with aerosol containers, and also is free of the disadvantages noted with respect to applicant's prior inventions. The dispensing device embodying the teachings of the present invention may be used on a container having any desirable configuration suitable for advertising or other purposes, since the container need not be designed to withstand internal pressures. Additionally, the actuating mechanism for the dispensing device of the invention does not comprise an end wall of the container itself, and thus sealing problems and manufacturing difficulties are obviated. Moreover, a dispensing device in accordance with the invention is much safer around small children than aerosol devices, and does not create any hazard of explosion when subjected to elevated temperatures and the like, as do aerosol devices. Still further, the dispensing device of the invention is much easier to operate than pump devices, which are rapidly increasing in popularity, and is more accurate to use than pump devices. Moreover, since the dispensing device of the invention does not rely upon aerosol products to dispense the material from the container, there is no likelihood of environmental pollution.

OBJECTS OF THE INVENTION

It is an object of this invention to provide a dispensing device which includes a container having the material to be dispensed therein, and wherein an external manually operable means is engaged through a gear arrangement with a reciprocable piston in the container, such that operation of the manually operable means in a first direction effects movement of the piston in a first direction to charge a dispensing chamber and a resilient means acts on the piston to move it in a second direction to dispense the material from the chamber.

Another object of the invention is to provide a dispensing device comprising a container having a material therein to be dispensed under pressure, and wherein manually operable movable means is in communication with the material for dispensing the material under pressure, said manually operable movable means including gear means operable from externally of the container, such that the container may be manufactured in any desirable configuration without the necessity of designing for withstanding internal pressures.

A further object of the invention is to provide a dispensing container for dispensing material under pressure, wherein a manually operated dispensing device is carried by the container, and wherein no pressurized aerosol products are used, thus enabling a much greater variety of products to be dispensed in view of the absence of any need for chemical compatibility between the material and aerosol products.

Yet another object of the invention is to provide a dispensing container for dispensing material under pressure wherein two manual steps are required in order to effect dispensing of the material, thus rendering the container safer for use around small children than conventional prior art devices.

Yet another object of the invention is to provide a container for dispensing material under pressure wherein a refill opening is provided for filling the container with a material to be dispensed.

A still further object of the invention is to provide a dispensing device for use on containers of a material to be dispensed under pressure, wherein the device may be attached to existing bottles or receptacles and the like.

BRIEF DESCRIPTION OF THE DRAWINGS

FIG. 1 is a fragmentary, top perspective view of a first form of dispensing device according to the invention.

FIG. 2 is a greatly enlarged view in section taken along line 2—2 of FIG. 1.

DETAILED DESCRIPTION OF THE PREFERRED EMBODIMENTS

Figure 3:
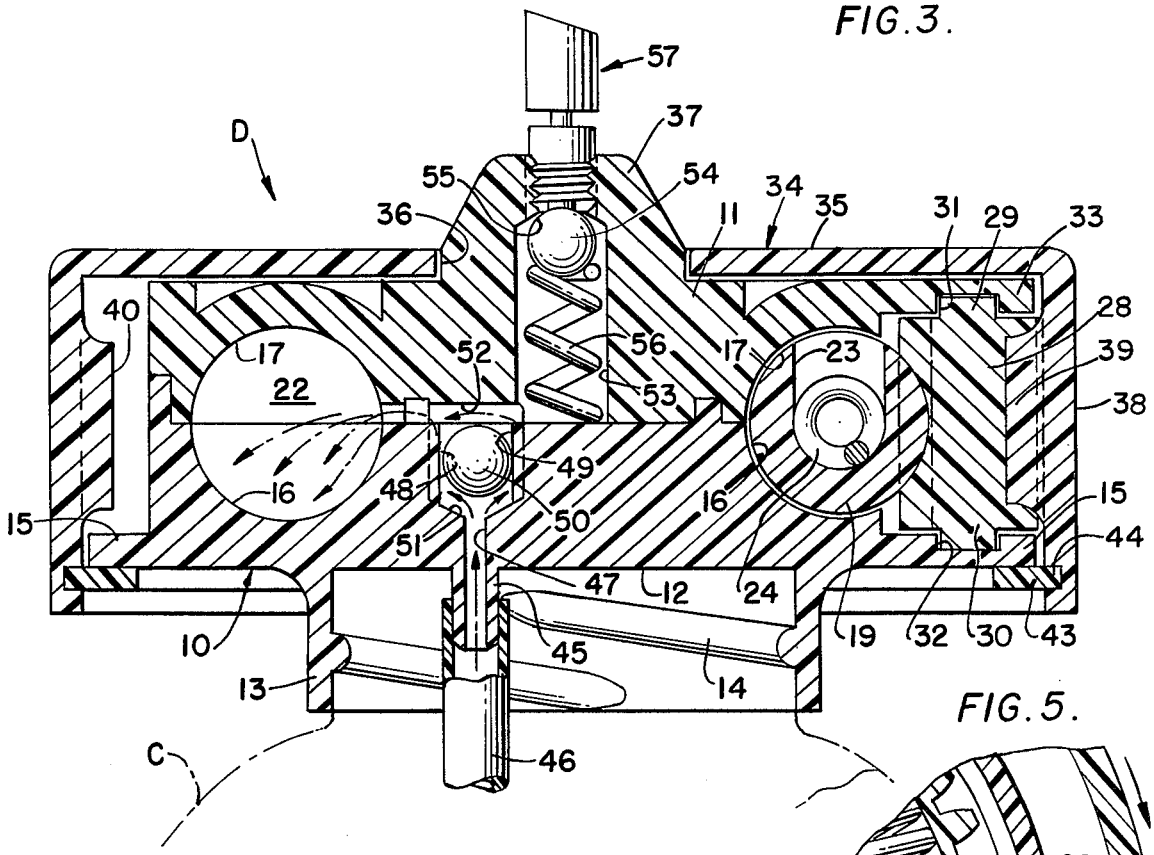
FIG. 3 is a vertical sectional view taken along line 3—3 in FIG. 2, showing the dispensing device in a position for charging the dispensing chamber.

In the drawings, wherein like reference numerals indicate like parts throughout the several views, a container C for containing a material to be dispensed has a dispensing device D in accordance with a first form of the invention attached thereto.

As seen in greater detail in FIGS. 2 and 3, the first form of dispensing device D comprises a container closure body 10 formed of mating top and bottom halves 11 and 12. A downwardly projecting cylindrical neck 13 is formed on the underside of portion 12 and has internal threads 14 formed therein for mating cooperation with external threads on the container C to secure the dispensing device D to the container. Other attaching means may be utilized in place of the threads 14, if desired. An annular, radially outwardly projecting lip or flange 15 is formed on the bottom marginal edge of bottom portion 12. The top surface of bottom portion 12 has an annular, semi-cylindrical cavity or channel 16 formed therein in mating registry with a like semi-cylindrical channel or cavity 17 in the underside of top portion 11, such that when the top and bottom portions 11 and 12 are assembled together, the channels 16 and 17 define a cylindrical annular piston chamber 18.

An arcuately shaped piston 19 is reciprocally mounted in the chamber 18 and has a piston face 20 which defines with an end wall 21 of the piston chamber 18 a cylindrical, annular dispensing chamber 22. The piston 19 is sealed relative to the piston chamber 18 by means of an annular seal S carried by the piston adjacent the piston head or face 20. The interior of the piston is hollow at 23 over a major portion of its length, and a coil spring 24 is extended at one end thereof into the hollow interior 23 of the piston 19 and is engaged at its other end over a short guide post 25 projecting from the other end 26 of the piston chamber 18. The hollow interior 23 may take the form of a U-shaped slot or channel 23' in the piston, shown in FIG. 3, for ease in manufacture of the device. A series of gear teeth 27 are formed along the length of the piston 19 on the outer side thereof in a position to be in meshed engagement with a pinion gear 28 having journals 29 and 30 on the opposite ends thereof rotatably received in aligned openings 31 and 32 formed in a radially outwardly projecting flange 33 on the top margin of top body portion 11 and the radially projecting flange 15 on the bottom body portion 12.

A rotatable loading member or piston actuating ring or cap 34 has a top wall 35 with a central opening 36 therethrough through which an upstanding projection 37 on the top body portion 11 projects, and an annular, cylindrical, depending wall or skirt 38 depends from the outer marginal edge of top wall portion 35. A plurality of gear tooth segments 39 and 40 are formed on the inner surface of the skirt 38 at circumferentially spaced locations, leaving interrupted segments or sections 41 and 42 therebetween.

An annular retaining ring 43 is received in an annular channel 44 in the inner bottom marginal surface of skirt 38, and the ring is engaged against the underside of flange 15 on bottom body portion 12 to retain the top and bottom body portions, piston, pinion gear and pinion actuating ring or loading member in assembled relationship.

The top and bottom body portions 11 and 12 are held in properly aligned mating relationship to one another by means of interengaging mating channels and ribs on the confronting faces thereof.

A downwardly projecting inlet nipple 45 is formed on the bottom surface of bottom body portion 12 spaced inwardly from the cylindrical neck 13 for receiving an inlet or suction tube 46 thereon. In use, the other end of the suction tube 46 extends to adjacent the bottom of the container. The nipple 45 has an axial bore 47 therein communicating at its upper end with an enlarged valve chamber 48 having a plurality of axially extending, circumferentially spaced apart guide ribs on the inner surface thereof for guiding a ball valve 50 relative to the valve seat 51 at the lower end of the chamber 48.

Figure 5:
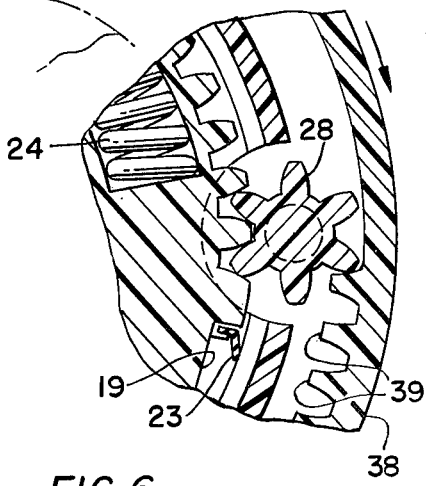
FIG. 5 is an enlarged fragmentary view in section of a portion of the actuating mechanism of the invention, showing the loading member and piston in the fully loaded or cocked position.
Figure 4:
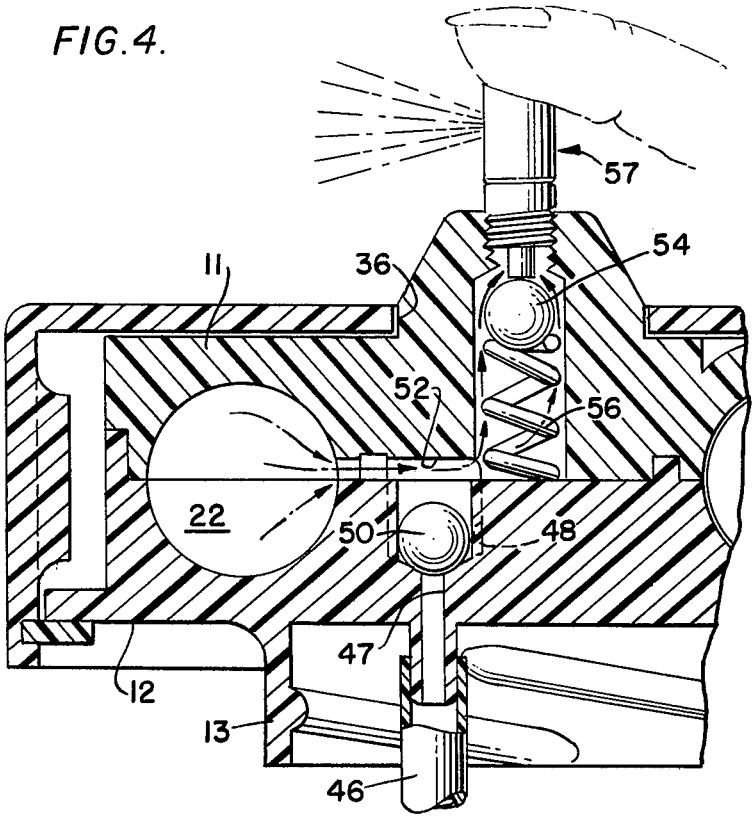
FIG. 4 is a view similar to FIG. 3 showing the dispensing device in a position for discharge of the material from the dispensing chamber through a nozzle.
Figure 6:
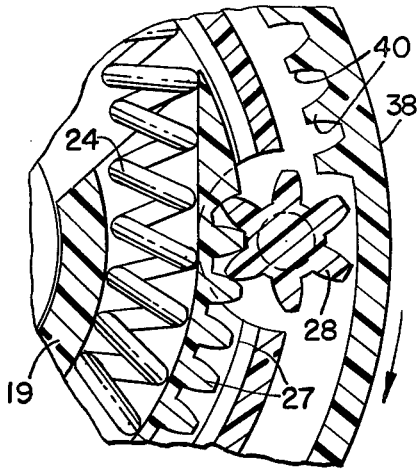
FIG. 6 is a view similar to FIG. 5 showing the piston and loading member or ring in an expended or discharge position.

The bottom surface of the top body portion 11 has a flow passage 52 formed therein in communication at one end with the valve chamber 48 and extending at its other end in communication with the dispensing chamber 22. Accordingly, when the loading member or piston actuating ring 34 is rotated in a first direction, the gear teeth 39 or 40 on the inner surface of the skirt 38 thereof engage with the pinion gear 28 to cause the pinion gear to rotate in the same direction as the loading member 34. The pinion gear 28 is also meshed with the gear teeth 27 on the piston, thus causing the piston to move in a counterclockwise direction, as seen in FIG. 2, thereby enlarging the dispensing chamber 22 and drawing material from the container through the tube 46 and passage 47 into the valve chamber 48 lifting the valve 50 from its seat, whereby the material flows through the passage 52 into the chamber 22. The loading member 34 is rotated through an arc equal in length to the length of one of the gear segments 39 or 40 which corresponds to the length of the gear segment 27 on the piston, thereby moving the piston to a fully cocked or withdrawn position, as seen in FIG. 5. The manually operated means may be constructed to operate by either a clockwise rotation or a counterclockwise rotation.

In the position shown in FIG. 5, the pinion gear 28 is in registry with one of the interrupted arc segments 41 or 42, whereby further rotation of the loading member or piston actuating ring 34 will not effect further action on the piston. Also, the external manually operable means does not move during the dispensing of material from the chamber.

An outlet passage 53 is formed coaxially within the top body portion 11 and is in communication at its lower end with the passage 52 extending from the valve chamber 48 and dispensing chamber 22. A ball valve 54 is normally held in closed relationship on a seat 55 by means of a coil spring 56 engaged between the ball valve 54 and the top surface of bottom body portion 12 at the lower end of outlet passage 53. A conventional spray nozzle 57 is suitably secured in the upper end of passage 53 and includes an actuating rod which projects downwardly when the nozzle is depressed to lift or move ball 54 away from its seat, thereby enabling the material in dispensing chamber 22 to be forced through passage 52 and passage 53 past the valve 54 and through the nozzle 57 under the action of the spring 24, which urges the piston in a direction to reduce the size of dispensing chamber 22, thereby pressurizing the contents thereof.

During the dispensing cycle, the pressure of the contents in dispensing chamber 22 maintains the inlet valve 50 closed on its seat 51, thereby preventing return of the material to the container C.

Figure 7:
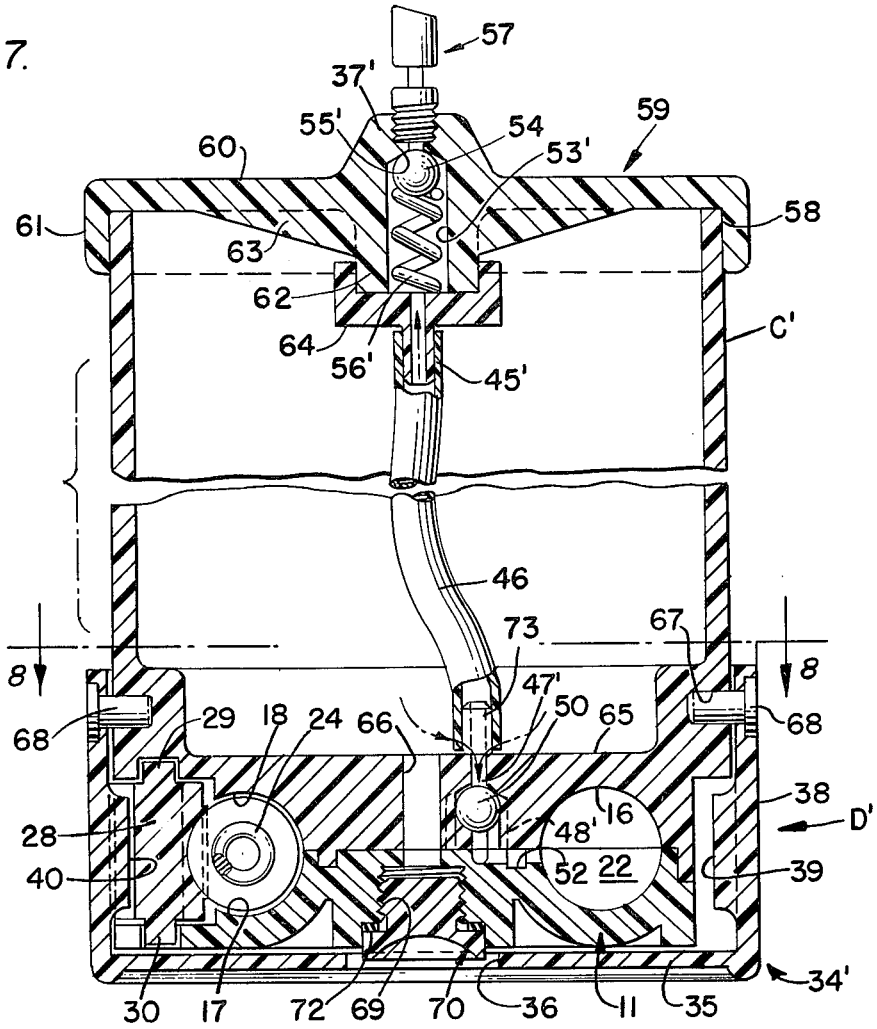
FIG. 7 is a vertical sectional view of a modification of the dispensing device of the invention, wherein the dispensing device is carried by the lower end of a container.
Figure 8:
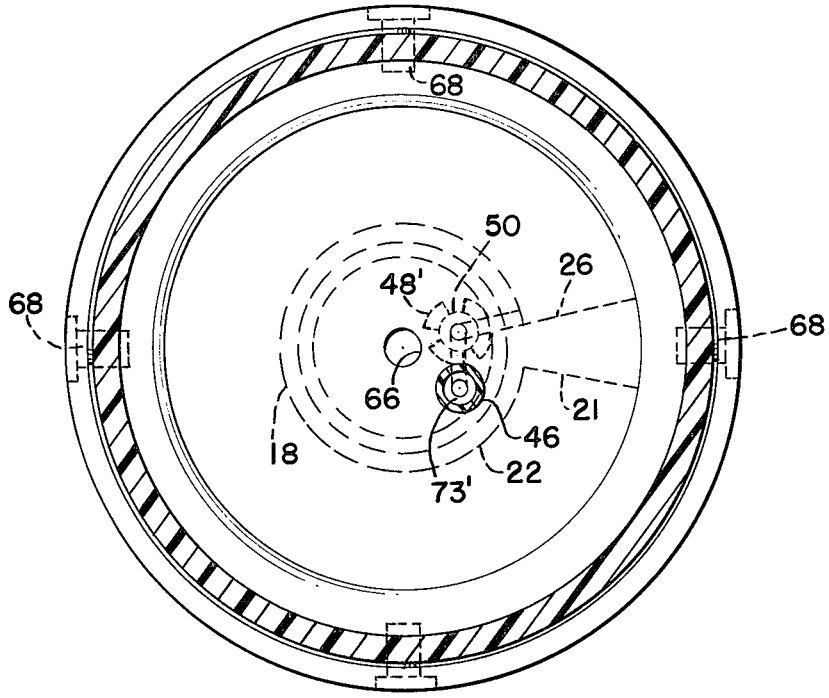
FIG. 8 is a view in section taken along line 8—8 in FIG. 7.

A modification of the invention is illustrated in FIGS. 7 and 8, and comprises a cannister or container C' of any suitable material, such as metal, plastic or glass and the like, and has an open top 58 closed by a dispensing end cover 59 having an end wall 60 and a depending annular skirt 61 within which the open upper end of cannister or container C' is received and sealed. The end closure or cover 59 has an upstanding central boss 37' thereon and a depending boss 62 in the center thereof extending inwardly of the container or cannister C'. An outlet passageway 53' is formed through the center of the bosses 62 and 37' and a ball valve 64' is positioned therein for cooperation with a valve seat 55' and is held against the seat by coil spring 56' to prevent escape of the contents of the container except when the spray nozzle 57' is actuated to move the ball 54' away from its seat. Radially extending gussets 63 are formed integrally with the end closure or cover 59 and the boss 62 to reinforce the end closure. An inverted, generally cup-shaped spring retaining cap 64 is suitably secured over the lower end of boss 62 to retain the coil spring 56' in the passageway 53' and the cap 64 has a downwardly projecting nipple 45' thereon for attachment thereto of a length of tubing 46.

The cannister or container C' has an integral bottom end closure or wall 65 with an annular, semi-cylindrical channel 16 formed in the underside thereof, and a central fill passage 66 extending therethrough. The bottom outer marginal surface portion of the container side wall has a circumferential channel 67 formed therein, in which a plurality of retaining pins 68 are received. The retaining pins 68 are extended inwardly through the upper marginal edge portion of skirt 38 of piston actuating ring or loading member 34'. The pins are slidable along the channel 67 to enable rotation of the ring 34', but prevent axial displacement of the ring from the container. As in the previous form of the invention, the ring 34' has a plurality of spaced gear teeth segments 39 and 40 formed on the inner surface of the skirt 38, and has an end wall 35 with a central opening 36 formed therethrough.

In this form of the invention, the bottom wall or closure 65 of the container C' corresponds generally to the bottom body portion 12 in the previously described form of the invention, and a mating body portion 11' is engaged therewith and has an annular, semi-cylindrical channel 17 in the surface thereof confronting the bottom closure 65 forming with the channel 16 in the closure 65 the annular cylindrical piston chamber 18, as in the previously described form of the invention.

A piston 19, identical to that previously described, is received in the piston chamber 18 and a coil spring 24 is engaged with the piston to urge it in a direction reducing the size of the dispensing chamber 22 formed between the piston and end wall 21 of the piston chamber 18.

Further, as in the previous form of the invention, a pinion gear 28 has opposite end trunnions 29 and 30 rotatably received in aligned openings in the end closure 65 and the body portion 11', respectively, and the gears thereof are in engagement with the gear segments 39 or 40 and the gears or gear teeth on the side of the piston 19.

The body portion 11' has a central opening 69 formed therethrough closed by a fill plug 70 having an actuator receiving slot 71 formed therein for removal of the plug 70, and a sealing gasket 72 is engaged between the plug and a shoulder surrounding the opening 69. Thus, the plug 70 may be removed for introduction of material through the openings 69 and 66 into the interior of the container.

As distinguished from the previously described form of the invention, in this form the dispensing chamber 22 is at the bottom of the container and a passageway 47' is formed through the bottom wall of closure 65 of the container, which is in communication with a valve chamber 48' at its lower end and in communication at its upper end with the contents of the container or cannister C'. A ball valve 50 is reciprocable in the valve chamber 48' and is guided toward and away from its valve seat by ribs 49. A passage 52' is formed in the upper surface of body portion 11' and extends from communication with the valve chamber 48' to the dispensing chamber 22. Thus, upon rotating the ring 38 in a first direction, the piston is caused to move in a first direction by engagement therewith of the pinion gear 28 causing the dispensing chamber 22 to enlarge and draw material from the container through the passage 47' past the valve 50 and through passage 52. When the ring has been turned an amount sufficient to fully load the piston, as shown, for example, in FIG. 5, the spring acts on the piston to move it in a direction to reduce the size of dispensing chamber 22 creating pressure therein, which moves the ball 50 upwardly against its seat, thus preventing return of the material into the container. At the same time, the pressurized material flows through a fitting 73 into the tube 47 and through fitting 45' into chamber 53'. However, the ball 54' is maintained against its seat by the spring 56', thus preventing escape of the material through the nozzle 57. When the nozzle 57 is operated, the ball 54' is moved from its seat, permitting escape of the material and enabling the piston to move under the action of the spring 24 to discharge the contents from the dispensing chamber 22.

Figure 9:
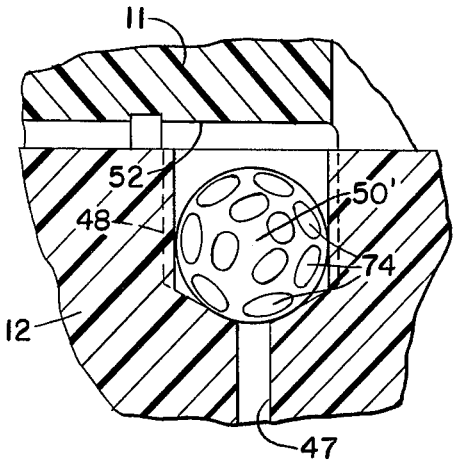
FIG. 9 is an enlarged fragmentary view in section of a modification of the inlet valve from the container to the dispensing chamber.

In FIG. 9, a further modification of the invention comprises a ball 50' having a plurality of flat spots or irregularities 74 on the surface thereof, thus enabling a slow leak back of the material from the dispensing chamber 22 to the interior of the container. This slow leak back of the material does not interfere with the normal operation of the device, wherein the ring 34 is moved to fully load the piston and the nozzle 57 then operated to discharge the contents from the chamber 22. However, it does prevent or eliminate the danger to small children and the like which might arise in the event the piston is moved to fully load dispensing chamber 22 and then the contents thereof are not discharged. Under these circumstances, someone could pick up the container and depress the nozzle 57 and effect an unexpected discharge of the material.

Figure 10:
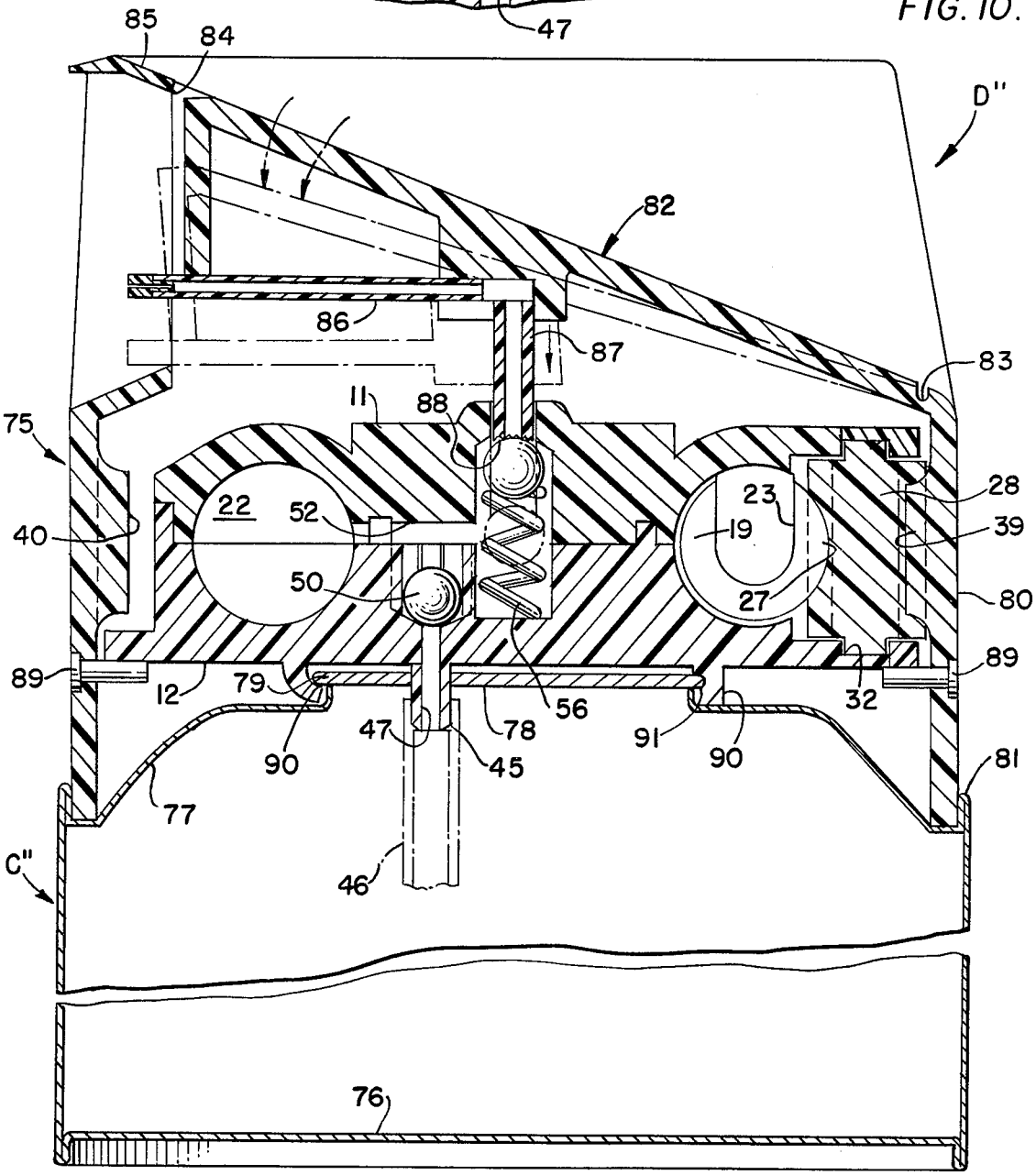
FIG. 10 is an enlarged sectional view, with portions broken away, of a further modification of the invention, wherein a cap type dispenser is attached to a container having a bead at the top thereof.

In FIG. 10, a further modified dispensing device D'' comprises an overcap 75 for attachment to a container C'' formed of metal or other suitable material and having a bottom 76 and top 77 with an upstanding central top portion 78 having a radially outwardly projecting annular bead or rim 79 thereon. The overcap 75 has a cylindrical, depending wall or skirt 80 with the bottom marginal edge thereof preferably received behind an upstanding crimped portion 81 on the upper end of the side wall of container C''. The cylindrical wall 80 also has the gear tooth segments 39 and 40 formed on the inner surface thereof, as in the previously described embodiments of the invention, for cooperation with a pinion gear 28 having journals at the opposite ends thereof received in recesses 31 and 32 formed in top and bottom body portions 11 and 12, respectively. An arcuately shaped piston 19 has gear teeth 27 on the outer surface thereof for cooperation with the pinion gear, as in the previously described form of the invention, and the piston defines with the body portions 11 and 12 a dispensing chamber 22. An inlet valve 50 communicates with a passage 47 extending through a boss or projection 45 for receiving a length of tubing 46 thereover for drawing material from the container into the chamber 22 when the piston is retracted by rotating the cap 75 which in turn causes rotation of the pinion gear 28. Material is dispensed from the chamber 22 by means of a dispensing button 82 joined to the cap by an integral flexible reduced section hinge portion 83. The button 82 is received in an opening 84 formed in the top 85 of the cap and carries a dispensing nozzle 86 and actuating tube 87 having a serrated bottom edge 88 for cooperation with valve 54 to open the valve when the button 82 is depressed, and thereby enable flow from the chamber 22 through passage 52 past valve 54 and through tube 87 and nozzle 86 to a point of use. A plurality of pins 89 or other suitable fastening means are extended through the skirt 80 of the cap and beneath the outer marginal edge of bottom body portion 12 to retain the body portions in operative position within the cap. The bottom body portion 12 has a reduced diameter, cylindrical skirt 90 on the underside thereof, which extends downwardly into close surrounding relationship with the beaded rim 79 and the skirt 90 may be heat deformed or otherwise suitably secured to the beaded rim 79 to lock the dispensing cap to the container. One or more keys 91 may be provided in the skirt and beaded rim to prevent rotation of the body portions when the cap is rotated. This form of the invention could also utilize a leak back valve, such as 50' in FIG. 9, if desired.

Figure 11:
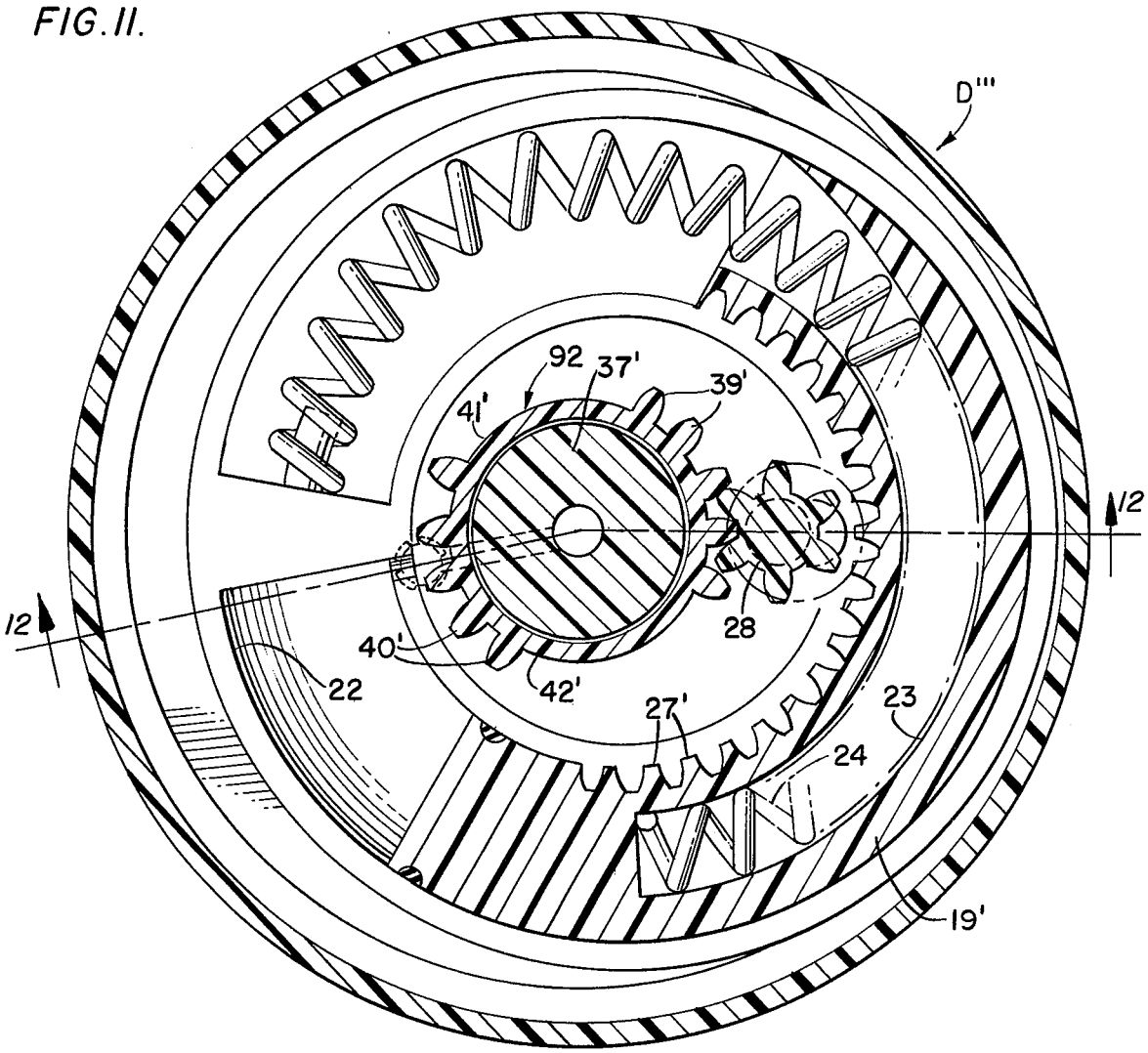
FIG. 11 is an enlarged horizontal sectional view of yet another modification of the invention, wherein the pinion gear is located adjacent the center of the operating cap.
Figure 12:
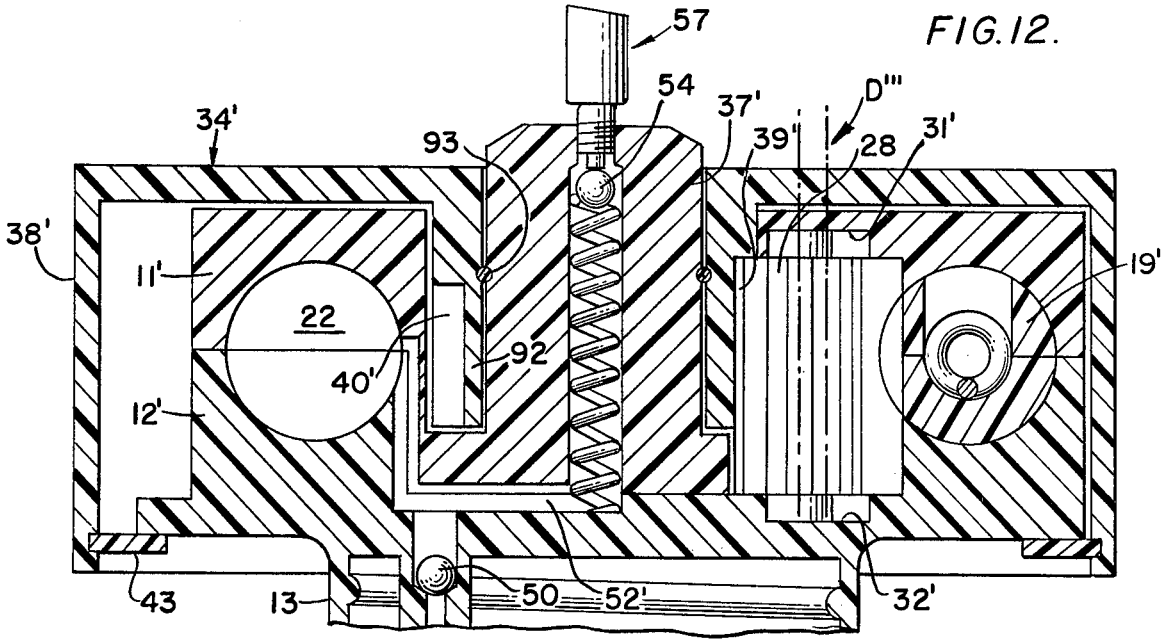
FIG. 12 is a sectional view taken along line 12—12 in FIG. 11.

A still further modification of the invention is illustrated in FIGS. 11 and 12, and the dispenser D''' in these figures is similar to that illustrated in FIG. 3, except that the pinion gear 28 is positioned radially inwardly of the arcuate piston 19' rather than outwardly thereof, as in FIG. 3. In this connection, the piston 19' has gear teeth 27' on the radially inner surface thereof for cooperation with the pinion gear, and the cap 34' has a cylindrical outer skirt 38', and a cylindrical inner skirt 92 having gear teeth segments 39' and 40' on the outer surface thereof, which cooperate with the pinion gear 28. Further, as seen best in FIG. 11, the body portions 11' and 12' are disposed eccentrically relative to the axis of the cap 34', whereby the piston is spaced radially from the teeth 39' and 40' on the inner skirt 92 of the cap 34' and moves about an arc having its axis offset from the axis of the skirt 92. Additionally, the pinion gear 28 has its opposite ends 29 and 30 received in elongate slots 31' and 32', respectively, whereby the pinion gear 28 is enabled to move radially inwardly and outwardly relative to the axis of the inner skirt 92. The amount of offset is selected such that the gear teeth 27' on the piston 19' can become disengaged from the pinion gear 28. In other words, when the cap 34' is rotated, one or the other of the gear segments 39', 40' engage the gears on the pinion gear 28 and produce a radial thrust, moving the pinion gear 28 radially outwardly to bring the pinion gear into engagement with the gear teeth 27' on the piston 19', and continued rotation of the cap 34' thus effects movement of the piston. However, when the piston is fully retracted and the dispensing chamber 22 loaded with material and the dispensing nozzle 57 operated to open valve 54, the spring 24 urges the piston 19' in a clockwise direction as viewed in FIG. 11 and the radial thrust produced by the gear teeth 27' on the piston acting on the pinion gear 28 moves the pinion gear 28 radially inwardly to disengage the pinion gear from the gear teeth 27', so that the piston is enabled to move to dispense the material from the chamber 22 without effecting rotation of the cap 34'.

As seen in FIGS. 11 and 12, the top body portion 11' has an elongate, upstanding, central portion 37' which the skirt 92 of the cap rotates around and the skirt 92 is sealed relative to the upstanding portion 37' by means of an O ring or the like 93.

It should be noted that the radial movement of the pinion gear 28 effects disengagement of the gear teeth on the piston with the pinion gear, whereby the piston may move without effecting rotation of the cap, even in the event the cap is rotated to partially load the chamber 22, thus leaving the pinion gear engaged with both the gear teeth on the piston and one or the other of the gear segments 39' and 40' on the skirt 92. In other words, it is possible that the chamber 22 may be loaded by effecting rotation of the cap to a degree which does not bring the pinion gear into registry with one of the interrupted arc segments 41' or 42' on the inner skirt 92.

The components of the dispensing device according to the invention may be made of any suitable material, such as plastic, metal, glass and the like, and the parts thereof may be suitably secured and sealed relative to one another in any suitable conventional manner.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. In a manually operated dispensing device for dispensing material under pressure, wherein the dispensing device is mounted on a container and has a discharge means for discharging the material from the container, a passage means in communication with the discharge means and with material to be dispensed, movable means in communication with the passage means for pressurizing the material and moving it through the passage means to the discharge means for discharge of the material for use as desired, and manually operable means on the dispensing device and accessible from exteriorly of the device for operating the movable means, the improvement comprising gear means including drivingly interengaged gear teeth on the manually operable means and the movable means for effecting actuation of the movable means when the manually operable means is moved, said gear means including means for effecting disengagement of said gear teeth on the manually operable means from the gear means on the movable means when the manually operable means has been moved a predetermined amount, so that continued movement of the manually operable means on the dispensing device does not cause further movement of the movable means, and to enable the movable means to move in a return direction without causing movement of the manually operable means.

2. A dispensing device as in claim 1, wherein the manually operable means is rotatable.

3. A dispensing device as in claim 2, wherein the movable means comprises a pump means for drawing material from the container, and the manually operable means is operable in a first direction to move the pump means in a first direction to draw material into a chamber of the pump means, and yieldable means acting on the pump means to move the pump means in a second direction to pressurize the material and discharge it through the discharge means.

4. A dispensing device as in claim 3, wherein the pump means comprises a piston reciprocable in a cylinder.

5. In a manually operated dispensing device for dispensing material under pressure, wherein the dispensing device has a discharge means for discharging the material from a container, passage means in communication with the discharge means and with material to be dispensed, movable means in communication with the passage means for pressurizing the material and moving it though the passage means to the discharge means for discharge of the material for use as desired, the movable means including a pump means for drawing material from the container and the manually operable means is operable in a first direction to move the pump means in a first direction to draw material into a chamber of the pump means, and yieldable means acting on the pump means to move the pump means in a second direction to pressurize the material and discharge it through the discharge means, the pump means comprising an arcuately shaped piston reciprocable in an arcuately shaped cylinder, the piston and cylinder being similarly shaped, and rotatable manually operable means accessible from exteriorly of the device for operating the movable means, the improvement comprising interengaged toothed gear means on the manually operable means and the movable means for effecting actuation of the movable means when the manually operable means is moved, said toothed gear means including gear teeth on the piston and means for disabling the gear means when the manually operable means has been moved a predetermined amount, so that continued movement of the manually operable means does not cause further movement of the movable means, and to enable the movable means to move in a return direction without causing movement of the manually operable means.

6. A dispensing device as in claim 5, wherein the gear means includes a pinion gear meshed with the gear teeth on the piston, and the manually operable means includes gear teeth meshed with the pinion gear, whereby rotatable operation of the manually operable means causes rotation of the pinion gear, which in turn causes reciprocation of the piston.

7. A dispensing device as in claim 6, wherein the manually operable means comprises a generally cup-shaped loading member on an end of the container having the material to be dispensed therein, the loading member including an end wall and a cylindrical skirt, the gear teeth on the manually operable means comprising gear teeth on an inner surface of said skirt.

8. A dispensing device as in claim 7, wherein the piston and cylinder define a dispensing chamber and one-way valve means communicate with the dispensing chamber and with the discharge means and with the material to be dispensed for controlling flow of the material to and from the dispensing chamber.

9. A dispensing device as in claim 8, wherein the dispensing device comprises an attachment for a container of material to be dispensed, and includes first and second mating body portions, each having a semi-cylindrical arcuate channel therein, with the channels in aligned registry with one another, thus defining the arcuate cylinder in which the piston is received, said pinion gear having its axis at right angles to the plane of movement of the piston, said loading member skirt extending coaxially over the body portions, and one of said body portions having fastening means thereon for attaching the device to a container of marterial to be dispensed.

10. A dispensing device as in claim 6, wherein the gear teeth on the manually operable means are interrupted at spaced locations defining lost motion areas which enable movement of the piston without effecting rotation of the manually operable means.

11. A dispensing device as in claim 8, wherein the dispensing device includes a pair of mated body portions, one of said body portions comprising an end wall of a container having material to be dispensed therein, each body portion having a semi-cylindrical arcuate channel therein with the channels in aligned registry with one another, thus defining the arcuate cylinder in which the piston is received, said pinion gear having its axis at right angles to the plane of movement of the piston, said loading member skirt extending coaxially over the body portions, and interengaging means on the skirt and container side wall holding the loading member to the container for rotation relative thereto by precluding axial movement relative thereto.

12. A dispensing device as in claim 6, wherein the pinion gear has journals at the opposite ends thereof, said journals received in slots elongated radially relative to the axis of the manually operable means, whereby the pinion gear is enabled to move radially for selective engagement and disengagement of the pinion gear with the gear teeth on the piston, to thus enable movement of the piston to dispense material without effecting movement of the manually operable means.

13. A dispensing device as in claim 12, wherein the pinion gear is disposed radially inwardly of the piston.

14. A dispensing device as in claim 6, wherein the dispensing device comprises an overcap secured to a container, said overcap having a depending, inner cylindrical wall fixed to an upstanding beaded rim on the container.

15. A dispensing device as in claim 8, wherein the valve means includes a first valve interposed between the dispensing chamber and material to be dispensed for enabling flow into the dispensing chamber but preventing reverse flow through the first valve, and said first valve includes leak passages for permitting slow leak back of the material from the dispensing chamber.

16. In a manually operated dispensing device mounted on a container for dispensing material under pressure, wherein the dispensing device has a discharge means for discharging the material from the container, passage means in communication with the discharge means and with material to be dispensed, pump means in communication with the passage means for pressurizing the material and moving it through the passage means to the discharge means for discharge of the material for use as desired, said pump means comprising an arcuately shaped piston reciprocable in an arcuately shaped cylinder, rotatable manually operable means accessible from exteriorly of the device for operating the pump means, said manually operable means operable in a first direction to move the pump means in a first direction to draw material into the pump means, yieldable means acting on the pump means to move the pump means in a second direction to pressurize the material and discharge it through the discharge means, the improvement comprising gear means engaged with the piston and with the manually operable means for effecting actuation of the piston, said gear means including gear teeth on the piston.

17. In a manually operated dispensing device for dispensing material under pressure from a container, wherein the dispensing device is mounted on the container and has a discharge means for discharging the material; passage means in communication with the discharge means and with material to be dispensed; means including movable and fixed elements forming an expansible chamber in communication with the container and having moving means for moving the movable element in a direction which discharges material from the expansible chamber, the expansible chamber and the passage means for drawing material from the container into the expansible chamber and for pressurizing the material in the expansible chamber and moving it through the passage means to the discharge means for discharge of the material for use as desired; and manually operable means connected with the movable element and accessible from exteriorly of the device for operating the movable element, the improvement comprising gear means including drivingly interengaged gear teeth on the movable element and the manually operable means for effecting movement of the movable element in one direction to load the expansible chamber with material to be dispensed when the manually operable means is moved in a first direction, said gear means including means for effecting disengagement of said gear teeth on the manually operable means from the gear teeth on the movable element for rendering the gear means inoperative when the manually operable means has been moved in said first direction to load the expansible chamber, whereby continued movement of the manually operable means on the dispensing device does not effect further movement of the movable element, and so that the movable element is enabled to move in the other direction without causing movement of the manually operable means, and movement of the movable element by the moving means in said other direction to dispense the material from the dispensing chamber repositions said gear means so that subsequent movement of the manually operable means in said first direction again causes movement of the movable element in said one direction.

* * * * *